US007872620B2

(12) United States Patent
Han et al.

(10) Patent No.: US 7,872,620 B2
(45) Date of Patent: Jan. 18, 2011

(54) PIXEL STRUCTURE USING VOLTAGE PROGRAMMING-TYPE FOR ACTIVE MATRIX ORGANIC LIGHT EMITTING DEVICE

(75) Inventors: Min-Koo Han, Seoul (KR); Jae-Hoon Lee, Seoul (KR)

(73) Assignee: Seoul National University Industry Foundation, Bongcheon-Dong, Gwanak-Gu, Seoul (KR)

( * ) Notice: Subject to any disclaimer, the term of this patent is extended or adjusted under 35 U.S.C. 154(b) by 893 days.

(21) Appl. No.: 11/412,525

(22) Filed: Apr. 27, 2006

(65) Prior Publication Data

US 2006/0256057 A1 Nov. 16, 2006

(30) Foreign Application Priority Data

Apr. 29, 2005 (KR) ..... P2005-36073
Oct. 4, 2005 (KR) ..... P2005-92966

(51) Int. Cl.
*G09G 3/32* (2006.01)

(52) U.S. Cl. ..... 345/82

(58) Field of Classification Search ..... 345/82–92, 345/204; 340/815.45; 250/552
See application file for complete search history.

(56) References Cited

U.S. PATENT DOCUMENTS 6,392,617 B1 * 5/2002 Gleason ..... 345/82
6,937,215 B2 * 8/2005 Lo ..... 345/82
2004/0196239 A1 * 10/2004 Kwon ..... 345/92
2005/0017934 A1 * 1/2005 Chung et al. ..... 345/82
2006/0145989 A1 * 7/2006 Han et al. ..... 345/92

OTHER PUBLICATIONS

RF and Microwave Semiconductor Device Handbook, CRC Press 2003, Chapter 6, section 6.2.2.*

* cited by examiner

*Primary Examiner*—Amr Awad
*Assistant Examiner*—Liliana Cerullo
(74) *Attorney, Agent, or Firm*—Cha & Reiter, LLC

(57) ABSTRACT

A pixel structure using a voltage programming type active matrix organic light emitting diode (OLED) which can minimize a current deterioration phenomenon. The pixel structure includes a fifth TFT receiving an external management signal EMS through its gate, having a drain region connected to a cathode part of an OLED, and receiving an input of an OLED current through its source-drain current path when the OLED emits light, a fourth TFT receiving a set scan signal SCAN through its gate and having source and drain regions connected to gate and drain parts of a third TFT T3; respectively, the third TFT T3 being a current driving transistor for determining the OLED current when the OLED emits light, a capacitor C having upper and lower plates connected to the gate part of the third TFT T3 and a ground voltage VSS.

5 Claims, 7 Drawing Sheets

PIXEL STRUCTURE USING VOLTAGE PROGRAMMING-TYPE FOR ACTIVE MATRIX ORGANIC LIGHT EMITTING DEVICE

PRIORITY

This application claims priority to applications entitled "Pixel Structure For Voltage Programming Type Active Matrix Organic Light Emitting Diode" filed in the Korean Industrial Property Office on Apr. 29, 2005 and assigned Serial No. 2005-36073, and on Oct. 4, 2005 and assigned Serial No. 2005-92966, the contents of which are hereby incorporated by reference.

BACKGROUND OF THE INVENTION

1. Field of the Invention

The present invention relates to an organic light emitting diode, and more particularly to a pixel structure using an organic light emitting diode which can prevent characteristic deterioration of driving transistors for driving a voltage programming type active matrix organic light emitting diode due to voltages being applied to the driving transistors.

2. Description of the Related Art

Recently, thin light inexpensive display devices having high efficiency have been actively developed, and one of such remarkable next-generation display devices is an organic light emitting display device. This organic light emitting display device uses an elector-luminescence (EL) phenomenon of specified organic compounds or high polymers, and thus it is not required to adopt a backlight in a display device. The display device using the EL phenomenon can be thinner than a general LCD, can be inexpensively and easily manufactured, and has the advantages of a wide viewing angle and bright light.

An organic light emitting display device using organic light emitting diodes (OLEDs) is provided with OLEDs and thin film transistors (TFTs) for driving the OLEDs. This TFT is classified into a poly silicon TFT, an amorphous silicon TFT, and others, depending on the kind of its active layer. Also, the type of the TFT is classified into an active-matrix type and a passive-matrix type, depending on the existence/nonexistence of switching elements provided in a unit pixel of an organic light emitting display panel.

Although the organic light emitting display device adopting the poly silicon TFTs has various kinds of advantages and thus has been generally used, the TFT manufacturing process is complicated with its manufacturing cost increased. In addition, it is difficult to achieve a wide screen in the organic light emitting display device adopting the poly silicon TFTs. By contrast, it is easy to achieve a wide screen in the organic light emitting display device adopting the amorphous silicon TFTs, and this organic light emitting display device can be manufactured through the relatively small number of manufacturing processes in comparison to the organic light emitting display device adopting the poly silicon TFTs. However, as the amorphous silicon TFTs continuously supply current to the OLED, the threshold voltage $V_{TH}$ of the amorphous silicon TFT itself may be shifted so as to cause the amorphous silicon TFT to deteriorate. Also, due to this, non-uniform current may flow through the OLED even if the same data voltage is applied thereto, and this causes the deterioration of picture quality of the organic light emitting display device to occur.

FIG. 1 is a circuit diagram of a unit pixel of a conventional voltage programming type active matrix OLED. This voltage programming type active matrix OLED is composed of two TFTs and one capacitor. In FIG. 1, the first TFT T1 serves as a switch such as an active matrix LCD, the capacitor $C_{STG}$ stores a data voltage, and the second TFT T2 serves to flow current corresponding to the value of the data voltage stored in the capacitor $C_{STG}$ to the OLED.

However, the voltage programming type basic pixel structure as illustrated in FIG. 1 has a drawback in that if the threshold voltage of the second TFT T2 deteriorates due to a continuous supply of a gate bias voltage, deteriorating voltage flows to the OLED through the second TFT T2 although the same data voltage is charged in the capacitor $C_{STG}$. Accordingly, the pixel structure as illustrated in FIG. 1 cannot correct the deterioration of the TFT threshold voltage between pixels at all. The current flowing between the source and drain of the second TFT T2 appears as the following current-voltage relational expression in a saturation region.

$$I_D = \frac{1}{2} \times k \times (V_{GS} - V_{TH})^2$$

Here, k=μ×Cins×W/L, and μ denotes a field effect mobility, Cins denotes the capacitance of an insulating layer, W denotes the channel width of a TFT, and L denotes the channel length of the TFT.

SUMMARY OF THE INVENTION

Accordingly, the present invention has been designed to solve the above and other problems occurring in the prior art, and an object of the present invention is to provide a pixel structure using a voltage programming type active matrix organic light emitting diode which can minimize a current deterioration phenomenon.

In one aspect of the present invention, there is provided a pixel structure using a voltage programming type active matrix organic light emitting diode (OLED), which includes a fifth switching transistor, i.e., a fifth TFT T5, receiving an external management signal EMS through its gate, having a drain region connected to a cathode part of an OLED, and receiving an input of an OLED current through its source-drain current path when the OLED emits light, a fourth switching transistor, i.e., a fourth switching transistor, i.e., a fourth TFT T4, receiving a set scan signal SCAN through its gate and having a source region and a drain region connected to a gate part and a drain part of a third TFT T3, respectively, the third TFT T3 being a current driving transistor for determining the OLED current when the OLED emits light, a capacitor C having an upper plate and a lower plate connected to the gate part of the third TFT T3 and a ground voltage VSS, respectively, a first switching transistor, i.e., a first TFT T1, receiving the scan signal SCAN through its gate and transferring a data voltage to a source region of the third TFT T3, a second switching transistor, i.e., a second TFT T2, receiving the external management signal EMS through its gate and connecting the lower part of the capacitor C to the source region of the third TFT T3, and a sixth transistor, i.e., a sixth TFT T6, having a source region and a drain region connected to an external clock signal CLK and the gate region of the third TFT T3, respectively, and having a gate connected to the gate part of the third TFT T3. In this case, an anode part of the OLED receives a voltage VDD.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE PREFERRED EMBODIMENTS

Preferred embodiments of the present invention will be described in detail hereinafter with reference to the accompanying drawings. In the following description of the present invention, only parts necessary for understanding the operation of the present invention will be explained, but a detailed description of known functions and configurations incorporated herein will be omitted when it may obscure the subject matter of the present invention.

Figure 1:
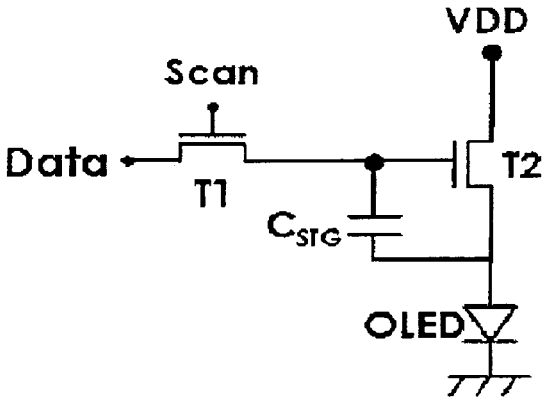
FIG.1 PRIOR ART
FIG. 1 is a circuit diagram of a unit pixel of a conventional voltage programming type active matrix OLED.
Figure 2:
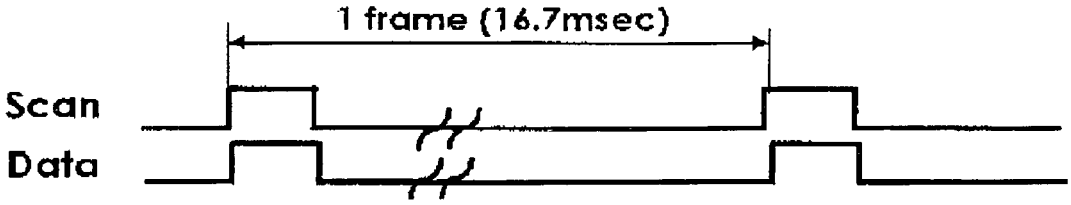
FIG.2 PRIOR ART
FIG. 2 is a timing diagram explaining the operation of the unit pixel of FIG. 1.
Figure 3:
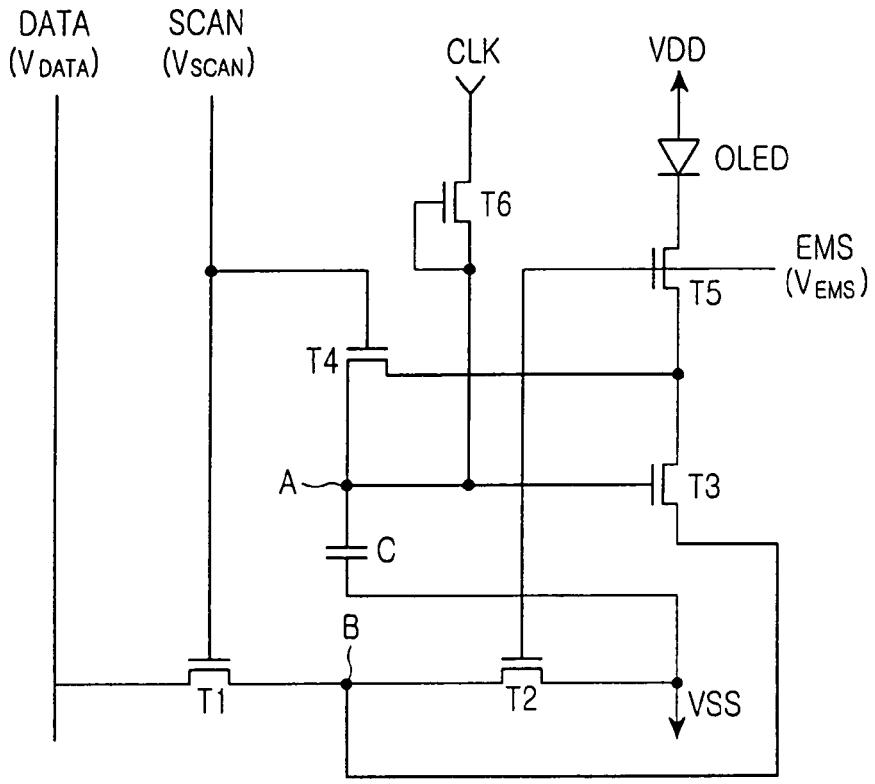
FIG. 3 is a circuit diagram of a unit pixel of a voltage programming type active matrix OLED according to a first embodiment of the present invention.
Figure 4:
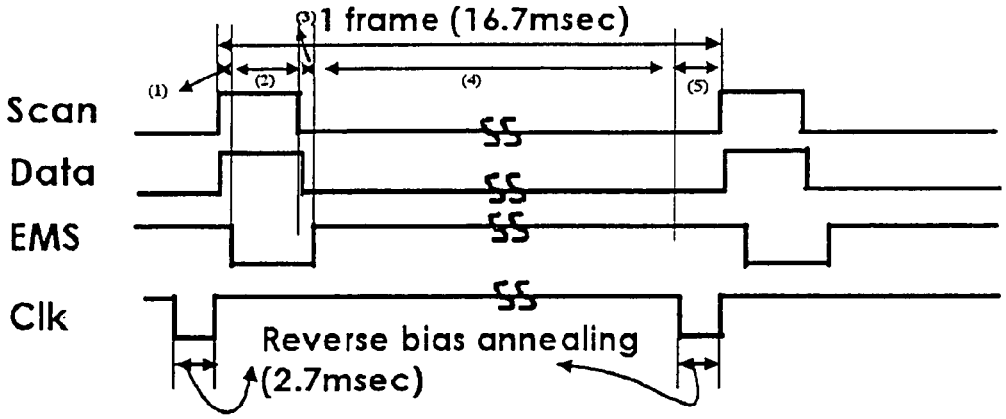
FIG. 4 is a timing diagram explaining the operation of the unit pixel of FIG. 3.

FIG. 3 is a circuit diagram of a unit pixel of a voltage programming type active matrix OLED according to a first embodiment of the present invention, and FIG. 4 is a timing diagram explaining the operation of the unit pixel of FIG. 3. Referring to FIGS. 3 and 4, the unit pixel according to the first embodiment of the present invention includes a fifth switching transistor, i.e., a fifth TFT T5, receiving an external management signal EMS through its gate, having a drain region connected to a cathode part of an OLED, and receiving an input of an OLED current through its source-drain current path when the OLED emits light, a fourth switching transistor, i.e., a fourth switching transistor, i.e., a TFT T4, receiving a set scan signal SCAN through its gate and having a source region and a drain region connected to a gate part and a drain part of a third TFT T3, respectively, the third TFT T3 being a current driving transistor for determining the OLED current when the OLED emits light, a capacitor C having an upper plate and a lower plate connected to the gate part of the third TFT T3 and a ground voltage VSS, respectively, a first switching transistor, i.e., a first TFT T1, receiving the external scan signal SCAN through its gate and transferring a data voltage to a source region of the third TFT T3, a second switching transistor, i.e., a second TFT T2, receiving the external management signal EMS through its gate and connecting the lower part of the capacitor C to the source regions of the third TFT T3, and a sixth transistor, i.e., a sixth TFT T6, having a source region and a drain region connected to an external clock signal CLK and the gate region of the third TFT T3, respectively, and having a gate connected to the gate part of the third TFT T3. In this case, an anode part of the OLED receives a high voltage VDD.

The operation of the unit pixel as constructed above according to the first embodiment of the present invention will be explained. In a period (1) of FIG. 4 where two control signals, i.e., the external management signal EMS and the scan signal SCAN, are all turned on, the fifth TFT T5 and the fourth TFT T4 connected to the third TFT T3 (e.g., driving TFT) are turned on, and the high voltage VDD is pre-charged in the gate node of the third TFT T3 through a diode connection of the third TFT T3 through the fifth TFT T5, to compensate for the threshold voltage of the third TFT T3. In a period (2) of FIG. 4 where the EMS signal goes to a low level and the SCAN signal is in an on state, the current path between the OLED and the third TFT T3 is removed due to the low voltage of the EMS signal, and simultaneously, the gate and the drain of the third TFT T3 are in a diode connection state. In this case, the third TFT T3 operates in a saturation region, and after a predetermined amount of time elapses, the voltage $V_{GS}$ of the third TFT T3 becomes the threshold voltage $V_{TH}$ of the third TFT T3. At this time, a data voltage having a positive value is applied to the source node (i.e., B node) of the third TFT T3. Accordingly, after the predetermined amount of time elapses, the voltage $V_G$ of the third TFT T3 becomes $[V_{TH}+V_{DATA}]$. Since VSS has been applied to the lower plate of the capacitor C connected to the gate of the third TFT T3, the voltage stored in the capacitor C becomes the difference between the voltage stored in the gate of the third TFT T3 and the ground voltage VSS, i.e., $[V_{TH}+V_{DATA}-VSS]$. In a period (3) of FIG. 4 where the two control signals are all at a low level, the SCAN signal is turned off until the EMS signal is turned on again, and thus a charge injection from the high voltage of the EMS signal to the gate of the fourth TFT T4 can be prevented. Last, if the EMS signal is turned on in a state that the SCAN signal is turned off, the current path between the third TFT T3 and the OLED is created again. In this case, the OLED is actually in a light-emitting state in a frame period as the voltage $V_{GS}$ stored in the capacitor in the period (2) is maintained (in a period (4) of FIG. 4). At this time, the current being discharged to the OLED is determined by the following current-voltage relational expression in a saturation region.

$$\begin{aligned} I_D &= 1/2\times k\times(V_{GS}-V_{TH})^2 \\ &= 1/2\times k\times(V_{TH}+V_{DATA}-VSS-V_{TH})^2 \\ &= 1/2\times k\times(V_{DATA}-VSS)^2 \end{aligned}$$

Here, $k=\mu\times Cins\times W/L$, and $\mu$ denotes a field effect mobility, Cins denotes the capacitance of an insulating layer, W denotes the channel width of a TFT (i.e., the third TFT T3 that is a current driving TFT), and L denotes the channel length of the TFT (T3 that is the current driving TFT).

In a period (5) of FIG. 4, a negative voltage can be applied to the gate node of the third TFT T3. Specifically, the sixth TFT T6 is added to the structure, which has a source region and a drain region connected to a terminal of a clock signal CLK and the gate node of the third TFT T3, respectively, and it achieves a diode connection by short-circuiting the gate region of the third TFT T3 and its gate region. When the clock signal CLK descends to a negative voltage, the sixth TFT T6 is turned on and discharges the charges existing at the gate node of the third TFT T3 as the negative voltage, so that the negative voltage is applied to the gate node of the third TFT T3 for a predetermined time. Accordingly, the deterioration of the threshold voltage of the third TFT T3 can be minimized, and this can contribute to the improvement of the reliability of the AMOLED panel. Of course, since the sixth TFT T6 is in an off state in the period where the clock signal is kept a positive voltage, the clock signal does not affect the determination of the OLED current.

Figure 5:
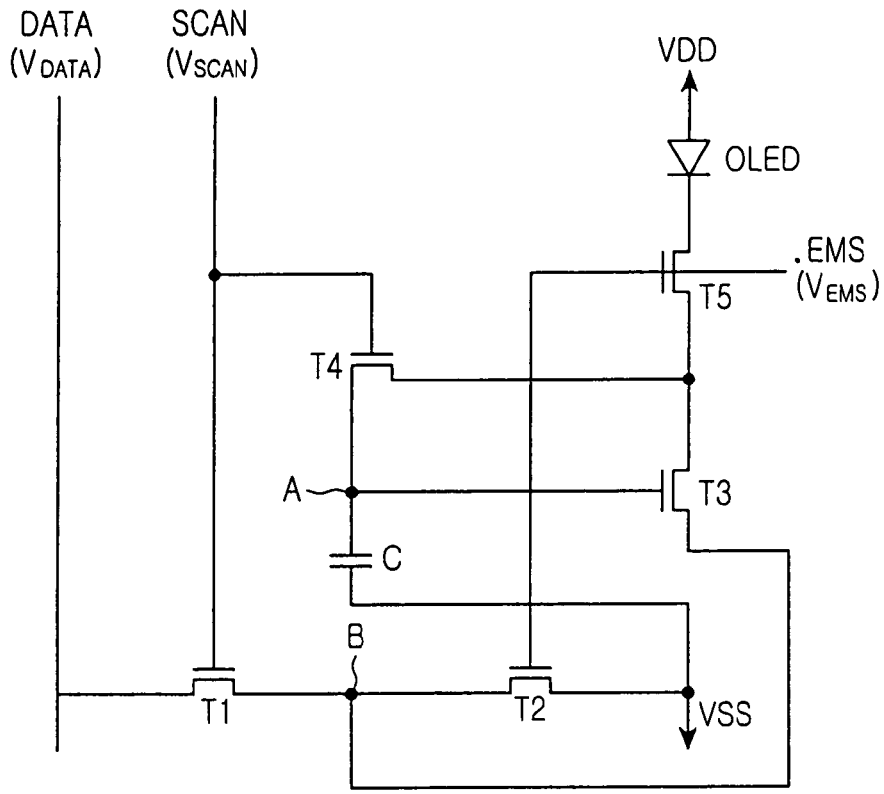
FIG. 5 is a circuit diagram of a unit pixel of a voltage programming type active matrix OLED according to a second embodiment of the present invention.
Figure 6:
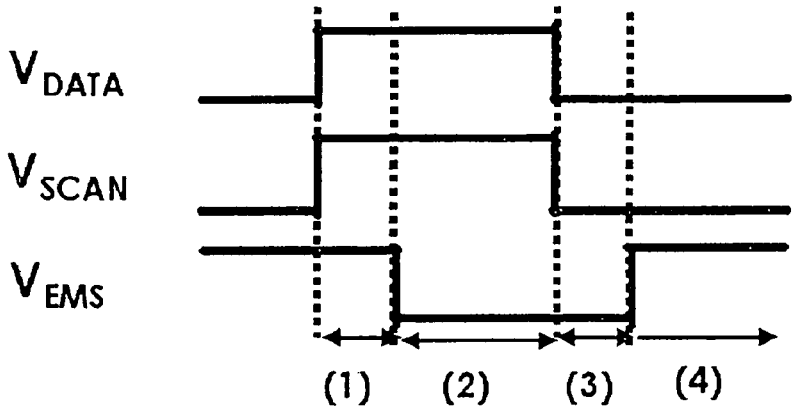
FIG. 6 is a timing diagram explaining the operation of the unit pixel of FIG. 5.

FIG. 5 is a circuit diagram of a unit pixel of a voltage programming type active matrix OLED according to a second embodiment of the present invention, and FIG. 6 is a timing diagram explaining the operation of the unit pixel of FIG. 5. Referring to FIGS. 5 and 6, the unit pixel according to the second embodiment of the present invention has the same construction as the unit pixel according to the first embodiment except that the sixth TFT T6 and the external clock signal CLK are removed from the circuit. In the first embodiment of the present invention as illustrated in FIG. 3, the external clock signal CLK having a negative voltage is periodically provided to the third TFT T3 through the sixth TFT T6, and thus the deterioration of the third TFT T3 is prevented. By contrast, in the second embodiment of the present invention as illustrated in FIG. 5, the deterioration of the third TFT T3 is somewhat severe in comparison to the first embodiment of the present invention, but it has the advantage that its circuit construction is simple. Except for the operation of the sixth TFT T6, the operation of the circuit according to the second embodiment of the present invention is the same as that according to the first embodiment of the present invention.

Figure 7:
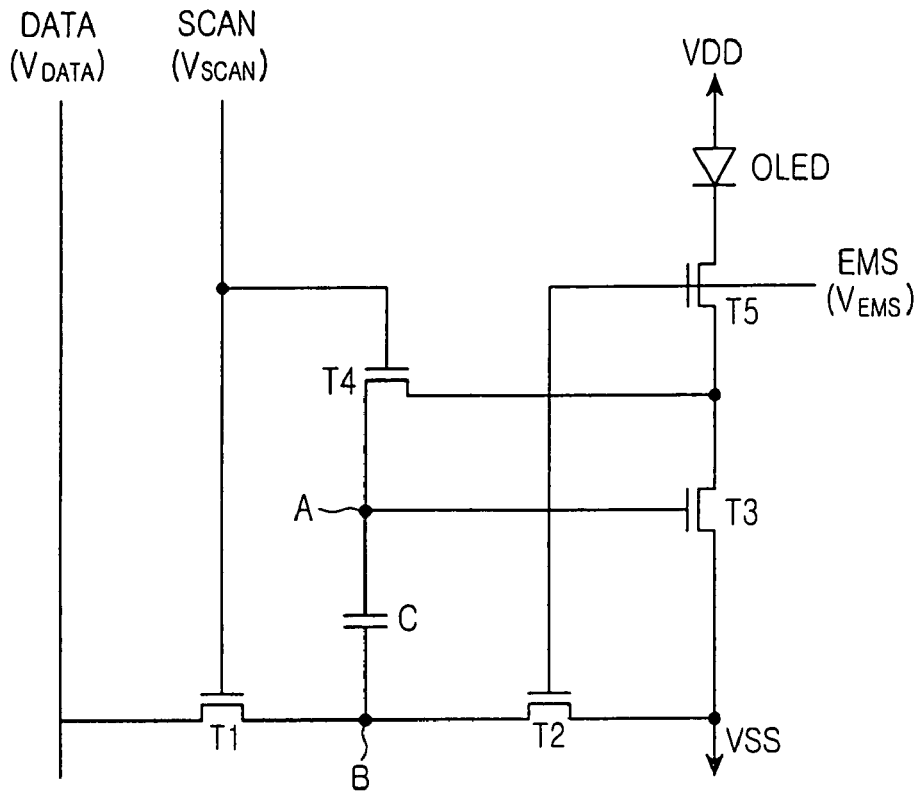
FIG. 7 is a circuit diagram of a unit pixel of a voltage programming type active matrix OLED according to a third embodiment of the present invention.
Figure 8:
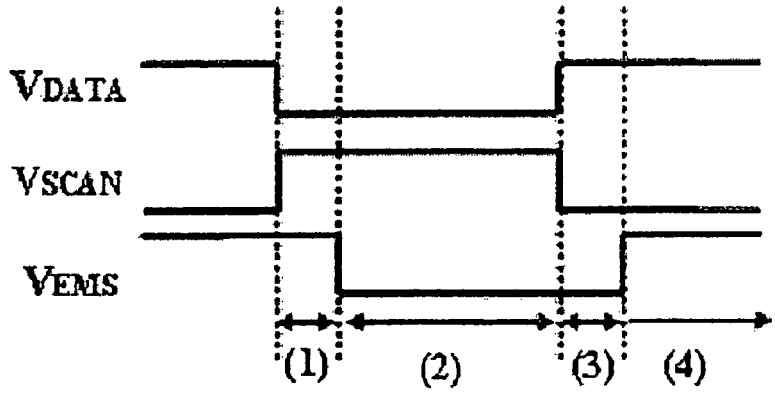
FIG. 8 is a timing diagram explaining the operation of the unit pixel of FIG. 7.

FIG. 7 is a circuit diagram of a unit pixel of a voltage programming type active matrix OLED according to a third embodiment of the present invention, and FIG. 8 is a timing diagram explaining the operation of the unit pixel of FIG. 7. Referring to FIGS. 7 and 8, in the unit pixel according to the third embodiment of the present invention, the source region of the third TFT T3 is directly connected to the ground voltage VSS, and the lower plate of the capacitor C is connected to the node B. The basic construction of the unit pixel as illustrated in FIG. 7 is similar to those of the first and second embodiments as illustrated in FIGS. 3 and 5, the data voltage has a positive value, not a negative value.

The operation of the unit pixel according to the third embodiment of the present invention will be explained. In a period (1) of FIG. 8 where two control signals, i.e., the external management signal EMS and the scan signal SCAN, are all turned on, the fifth TFT T5 and the fourth TFT T4 connected to the third TFT T3 (e.g., driving TFT) are turned on, and the high voltage VDD is pre-charged in the gate node of the third TFT T3 through a diode connection of the third TFT T3 through the fifth TFT T5, to compensate for the threshold voltage of the third TFT T3. In a period (2) of FIG. 8 where the EMS signal goes to a low level and the SCAN signal is in an on state, the current path between the OLED and the third TFT T3 is removed due to the low voltage of the EMS signal, and simultaneously, the gate and the drain of the third TFT T3 are in a diode connection state. In this case, the third TFT T3 operates in a saturation region, and after a predetermined amount of time elapses, the voltage $V_{GS}$ of the third TFT T3 becomes the threshold voltage $V_{TH}$ of the third TFT T3. At this time, a data voltage $V_{DATA}$ is applied to the lower plate of the capacitor C (i.e., node B) connected to the gate of the third TFT T3 by the first TFT T1, and VSS is applied to the source of the third TFT T3. Since the voltage stored in the capacitor C corresponds to the difference between the voltage stored in the gate of the third TFT T3 ($V_{TH}$+VSS) and the data voltage VDD, it becomes [$V_{TH}$+VSS−$V_{DATA}$]. In a period (3) of FIG. 8 where the two control signals EMS and SCAN are all at a low level, the SCAN signal is turned off until the EMS signal is turned on again, and thus a charge injection from the high voltage VDD to the gate of the third TFT T3 can be prevented. Last, in a period (4) of FIG. 8 where the EMS signal is turned on in a state that the SCAN signal is turned off, the current path between the third TFT T3 and the OLED is created again. In this case, the OLED is actually in a light-emitting state in a frame period as the voltage $V_{GS}$ stored in the capacitor C is maintained. At this time, the current being discharged to the OLED is determined by the following current-voltage relational expression in a saturation region.

$$\begin{aligned} I_D &= 1/2 \times k \times (V_{GS} - V_{TH})^2 \\ &= 1/2 \times k \times (V_{TH} + VSS - V_{DATA} - V_{TH})^2 \\ &= 1/2 \times k \times (VSS - V_{DATA})^2 \end{aligned}$$

Here, k=μ×Cins×W/L, and μ denotes a field effect mobility, Cins denotes the capacitance of an insulating layer, W denotes the channel width of a TFT (i.e., the third TFT T3 that is a current driving TFT), and L denotes the channel length of the TFT (T3 that is the current driving TFT).

By adding the sixth TFT T6 to the construction in the third embodiment of the present invention, in the similar manner as the construction in the first embodiment of the present invention, the negative voltage can be periodically applied to the gate node of the third TFT T3. That is, by adding the sixth TFT T6 to the structure, which has a source region and a drain region connected to a terminal of a clock signal CLK and the gate node of the third TFT T3, respectively, and which achieves a diode connection by short-circuiting the gate region of the third TFT T3 and its gate region, the deterioration of the threshold voltage of the third TFT T3 can be minimized.

Figure 9:
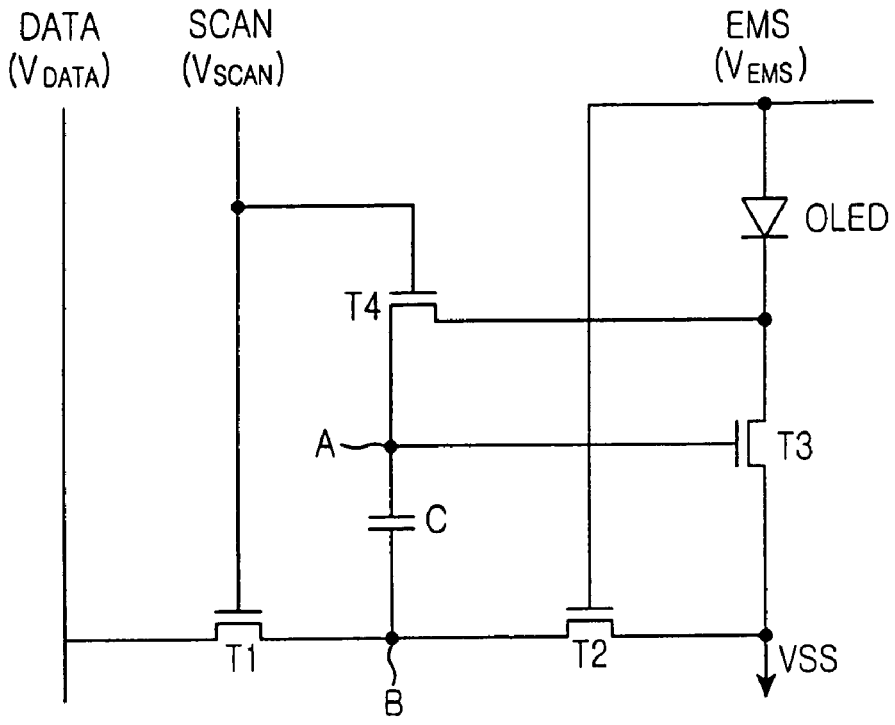
FIG. 9 is a circuit diagram of a unit pixel of a voltage programming type active matrix OLED according to a fourth embodiment of the present invention.
Figure 10:
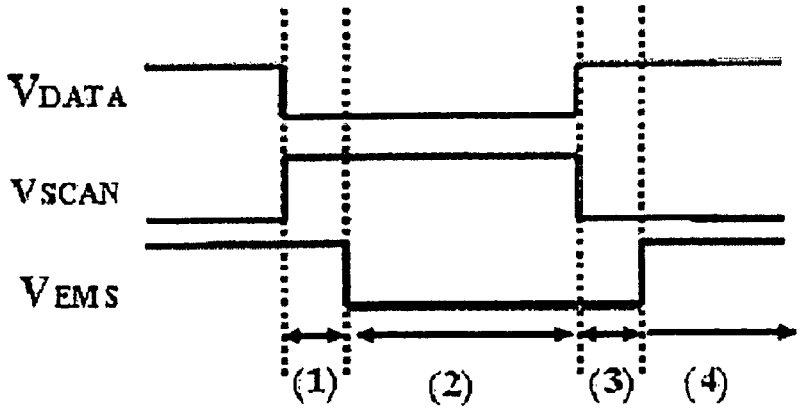
FIG. 10 is a timing diagram explaining the operation of the unit pixel of FIG. 9.

FIG. 9 is a circuit diagram of a unit pixel of a voltage programming type active matrix OLED according to a fourth embodiment of the present invention, and FIG. 10 is a timing diagram explaining the operation of the unit pixel of FIG. 9. The unit pixel of the voltage programming type active matrix OLED having the construction as illustrated in FIG. 9 is composed of four N-type TFTs and a capacitor. Although the scan signal SCAN and the data signal DATA, which are essential signals for the pixel, are used, the VDD line that is the power supply line is replaced by a $V_{EMS}$ signal line by applying the voltage $V_{EMS}$ to the gate node of the second TFT T2 and the anode of the OLED.

The operation of the unit pixel according to the fourth embodiment of the present invention will be explained. In a period (1) of FIG. 10 where two control signals, i.e., the external management signal EMS and the scan signal SCAN, are all turned on, a high voltage $V_{EMS}$ connected in series to the OLED is pre-charged in the gate node (i.e., A node) through a diode connection of the third TFT T3 through the fourth TFT T4, to compensate for the threshold voltage of the third TFT T3. In a period (2) of FIG. 10 where the EMS signal goes to a low level and the SCAN signal is in an on state, the current path between the OLED and the third TFT T3 is removed due to the low voltage of the EMS signal, and simultaneously, the gate and the drain of the third TFT T3 are in a diode connection state. In this case, the third TFT T3 operates in a saturation region, and after a predetermined amount of time elapses, the voltage $V_{GS}$ of the third TFT T3 becomes the threshold voltage $V_{TH}$ of the third TFT T3.

The voltage $V_{DATA}$ of the data signal is applied to the lower plate of the capacitor C (i.e., node B) connected to the gate of the third TFT T3. Since the voltage stored in the capacitor C corresponds to the difference between the voltage stored in the gate of the third TFT T3 and the data voltage $V_{DATA}$, it becomes [VSS+$V_{TH}$−$V_{DATA}$]. In this case, since the OLED current flowing in an emission period is determined by the value stored in the capacitor C, the input data voltage $V_{DATA}$ should be a data having a negative value. In a period (3) of FIG. 10 where the two control signals EMS and SCAN are all at a low level, the SCAN signal is turned off until the EMS signal is turned on again, and thus a charge injection from the high voltage of the EMS signal to the gate of the third TFT T3 can be prevented. Last, if the EMS signal is turned on in a state that the SCAN signal is turned off, the current path between the third TFT T3 and the OLED is created again. In this case, the OLED is actually in a light-emitting state in a frame period as the voltage $V_{GS}$ stored in the capacitor C is maintained. Also, in the actual emission period (4) of FIG. 10, only the driving TFT (i.e., the third TFT T3) for determining the amount of discharged current is connected between the power supply (i.e., the high voltage of the EMS signal) and the OLED, the power consumption becomes minimized. At this time, the current being discharged to the OLED is determined by the following current-voltage relational expression in a saturation region.

$$\begin{aligned} I_D &= 1/2 \times k \times (V_{GS} - V_{TH})^2 \\ &= 1/2 \times k \times (VSS + V_{TH} - V_{DATA} - V_{TH})^2 \\ &= 1/2 \times k \times (VSS - V_{DATA})^2 \end{aligned}$$

Here, k=μ×Cins×W/L, and μ denotes a field effect mobility, Cins denotes the capacitance of an insulating layer, W denotes the channel width of a TFT (i.e., the third TFT T3 that is a current driving TFT), and L denotes the channel length of the TFT (T3 that is the current driving TFT).

Figure 11:
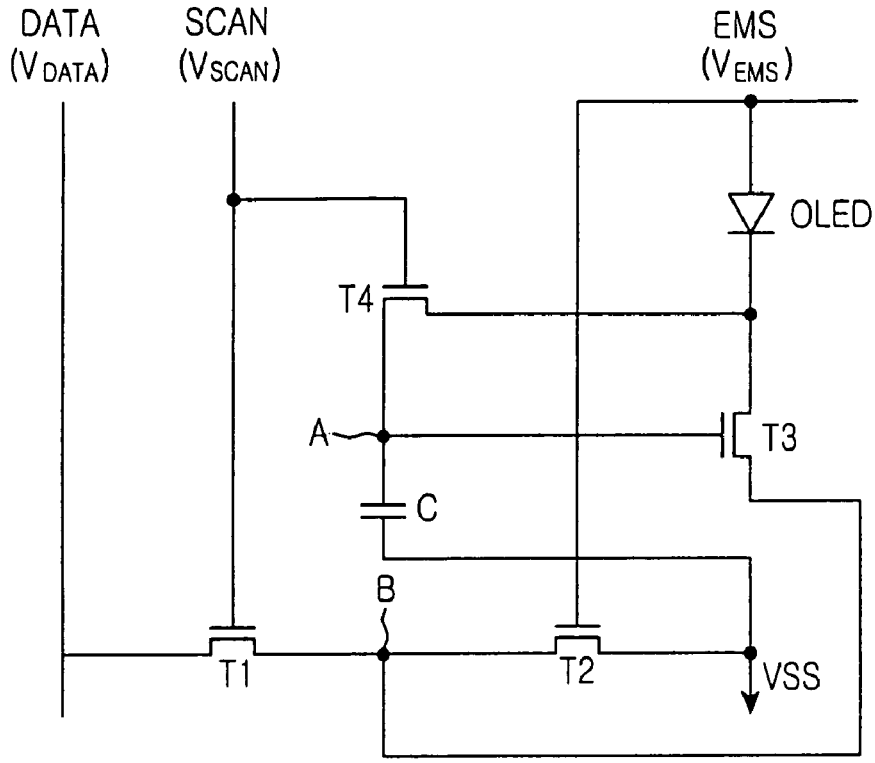
FIG. 11 is a circuit diagram of a unit pixel of a voltage programming type active matrix OLED according to a fifth embodiment of the present invention.
Figure 12:
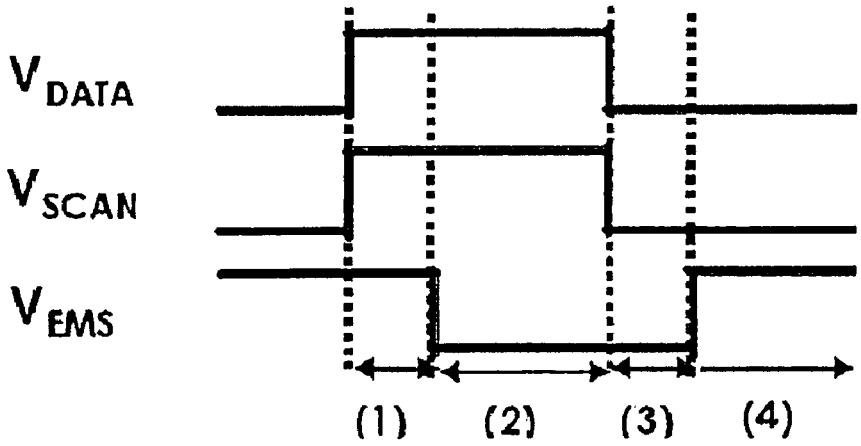
FIG. 12 is a timing diagram explaining the operation of the unit pixel of FIG. 11.

FIG. 11 is a circuit diagram of a unit pixel of a voltage programming type active matrix OLED according to a fifth embodiment of the present invention, and FIG. 12 is a timing diagram explaining the operation of the unit pixel of FIG. 11. Referring to FIGS. 11 and 12, the unit pixel according to the fifth embodiment of the present invention is the same as that according to the first embodiment of the present invention. In the fifth embodiment of the present invention, however, the data voltage has a negative value, not a positive value.

The operation of the unit pixel as constructed above according to the fifth embodiment of the present invention will be explained. In a period (1) of FIG. 12 where two control signals EMS and SCAN are all turned on, the high voltage $V_{EMS}$ is pre-charged in the gate node (i.e., A node) through a diode connection of the third TFT T3 through the fourth TFT T4, to compensate for the threshold voltage of the third TFT T3. In a period (2) of FIG. 12 where the EMS signal goes to a low level and the SCAN signal is in an on state, the current path between the OLED and the third TFT T3 is removed due to the low voltage of the EMS signal, and simultaneously, the gate and the drain of the third TFT T3 are in a diode connection state. In this case, the third TFT T3 operates in a saturation region, and the data voltage having the positive value is applied to the source node (i.e., B node) of the third TFT T3. Accordingly, after a predetermined amount of time elapses, the voltage $V_G$ of the third TFT T3 becomes [$V_{TH}$+$V_{DATA}$]. Since VSS has been applied to the lower plate of the capacitor C connected to the gate of the third TFT T3, the voltage stored in the capacitor C becomes the difference between the voltage stored in the gate of the third TFT T3 and the ground voltage VSS, i.e., [$V_{TH}$+$V_{DATA}$−VSS]. In a period (3) of FIG. 12 where the two control signals are all at a low level, the SCAN signal is turned off until the EMS signal is turned on again, and thus a charge injection from the high voltage of the EMS signal to the gate of the fourth TFT T4 can be prevented. Last, if the EMS signal is turned on in a state that the SCAN signal is turned off, the current path between the third TFT T3 and the OLED is created again. In this case, the OLED is actually in a light-emitting state in a frame period as the voltage $V_{GS}$ stored in the capacitor in the period (2) is maintained. Also, in the actual emission period (4) of FIG. 12, only the driving TFT (i.e., the third TFT T3) for determining the amount of discharged current is connected between the power supply (i.e., the high voltage of the EMS signal) and the OLED, the power consumption becomes minimized. At this time, the current being discharged to the OLED is determined by the following current-voltage relational expression in a saturation region.

$$\begin{aligned} I_D &= 1/2 \times k \times (V_{GS} - V_{TH})^2 \\ &= 1/2 \times k \times (V_{TH} + V_{DATA} - VSS - V_{TH})^2 \\ &= 1/2 \times k \times (V_{DATA} - VSS)^2 \end{aligned}$$

Here, k=μ×Cins×W/L, and μ denotes a field effect mobility, Cins denotes the capacitance of an insulating layer, W denotes the channel width of a TFT (i.e., the third TFT T3 that is a current driving TFT), and L denotes the channel length of the TFT (T3 that is the current driving TFT).

Figure 13:
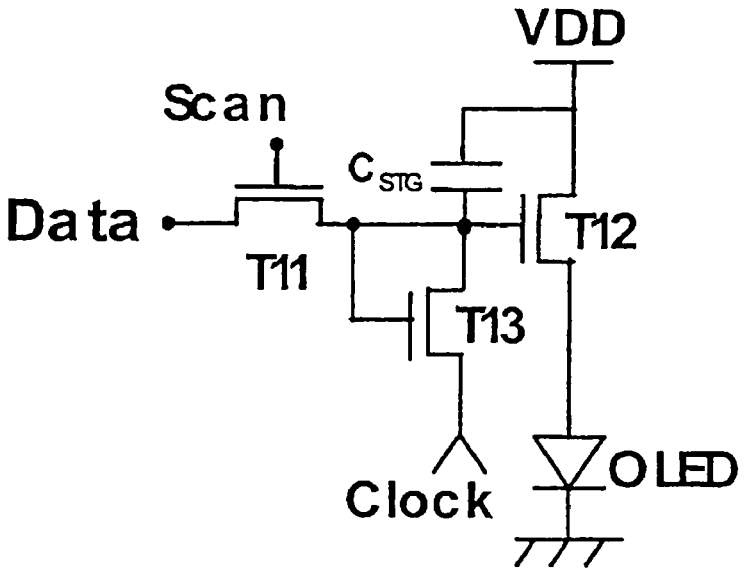
FIG. 13 is a circuit diagram of a unit pixel of a voltage programming type active matrix OLED according to a sixth embodiment of the present invention.
Figure 14:
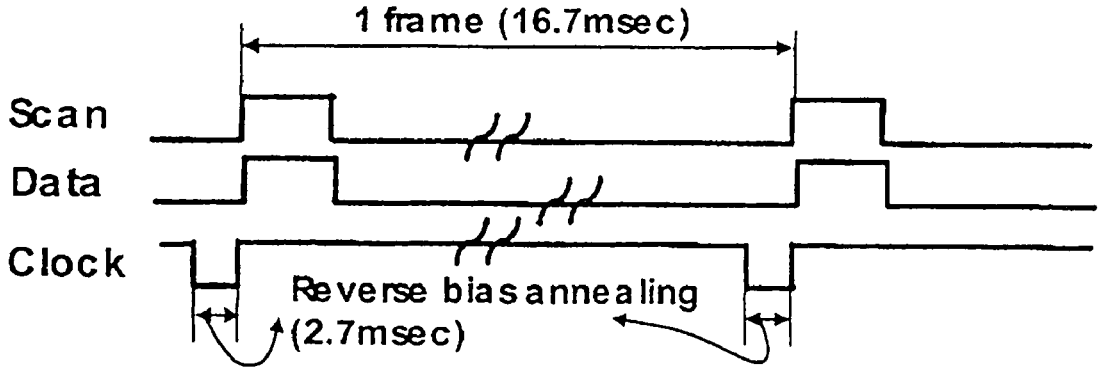
FIG. 14 is a timing diagram explaining the operation of the unit pixel of FIG. 13.

FIG. 13 is a circuit diagram of a unit pixel of a voltage programming type active matrix OLED according to a sixth embodiment of the present invention, and FIG. 14 is a timing diagram explaining the operation of the unit pixel of FIG. 13. Referring to FIGS. 13 and 14, the unit pixel of the voltage programming type active matrix OLED according to the sixth embodiment of the present invention is composed of three N-type TFTs (i.e., the $11^{th}$ TFT T11, the $12^{th}$ TFT T12, and the $13^{th}$ TFT T13) and a capacitor $C_{STG}$. In addition to the scan signal SCAN and the data signal DATA, which are essential signals for the pixel, a clock signal is applied to the source and the drain of the third switching transistor (i.e., third TFT T3). In operation, the $13^{th}$ TFT T13 and a clock signal line is formed for each row of the panel, and thus the pixel of the actual panel is driven by two TFTs.

Referring to FIGS. 13 and 14, the operation of the unit pixel according to the sixth embodiment of the present invention will be explained. During a gate selection time, the $11^{th}$ TFT T11 is turned on, and the data voltage is stored in the capacitor $C_{STG}$. After the gate selection time, the $12^{th}$ TFT T12 supplies the current corresponding to the applied data voltage to the OLED. At this time, since the clock signal connected to the $13^{th}$ TFT T13 has a voltage higher than the data voltage, the source of the $13^{th}$ TFT T13 becomes the gate node of the $12^{th}$ TFT T12. Accordingly, the $13^{th}$ TFT T13 is turned off since $V_{GS_T3}$=0. If the clock signal is shifted to a voltage state (i.e., a negative voltage) that is sufficiently lower than the stored data voltage (i.e., a positive voltage), the clock signal appears at the source of the $13^{th}$ TFT T13, and at this time, the data voltage having been stored in the gate node of the $12^{th}$ TFT T12 (i.e., the drain node of the $13^{th}$ TFT T13) is discharged to the clock signal. Accordingly, the gate node of the $12^{th}$ TFT T12 maintains the potential of the negative voltage.

On the other hand, as the positive voltage is continuously applied to the gate node, the threshold voltage of the hydrogen amorphous silicon (a-Si:H) is increased. This phenomenon can be explained by two kinds of mechanisms: a charge capture to a silicon nitride layer and a defect region generation in a channel. Generally, it is known that stress occurring due to the applying of a positive voltage to the gate node increases the relative density of the charge capture, while stress due to the applying of a negative voltage to the gate node decreases the captured charge and defect state density. Accordingly, in the present invention, the deterioration of the threshold voltage caused by the continuous applying of the positive voltage to the gate node of the amorphous silicon thin film transistor can be reduced by applying the negative voltage to the gate node. For example, a positive voltage is applied to the gate node of a unit device for 14 msec of 16.7 msec that corresponds to one frame, and a negative voltage is applied for the remaining 2.7 msec. The duty ratio and the magnitude of the negative voltage can be diversely set for each panel design. In addition, the driving method proposed in the present invention can suppress the current error due to the hysteresis phenomenon of the a-Si TFT by applying a constant negative voltage before the driving voltage $V_{GS}$ in the current frame.

In addition, the driving method proposed with reference to FIG. 13 can suppress the deterioration of the threshold voltage itself by applying a negative voltage to the gate node of the current driving TFT.

Although the construction and operation of the pixel structure using a voltage programming type active matrix OLED have been described with reference to the preferred embodiments of the present invention, they are exemplary, and various modifications can be made without departing from the scope of the present invention. For example, even in the construction according to the embodiments as illustrated in FIGS. 9 and 11, the same construction as the sixth TFT T6, which prevents the deterioration of the third TFT T3 by periodically providing an external clock signal CLK having a negative voltage to the third TFT T3 through the sixth TFT T6, proposed in the first embodiment of the present invention as illustrated in FIG. 3, can also be adopted. Also, since the circuit, which is composed of N-type TFTs according to the present invention, can be constructed using P-type TFTs, thin film transistors such as nanocrystalline-Si TFTs, polycrystalline-Si TFTs, organic TFTs, oxide (transparent) TFTs, and others, can be used in driving the AMOLED display device, in addition to a-Si TFTs. Also, although in the embodiments of the present invention, the OLED has a common-anode structure, the present invention can be widely used for an OLED having a common-cathode structure.

As described above, the pixel structure for the voltage programming type active matrix OLED according to the first embodiment of the present invention can minimize the OLED current reduction phenomenon even if the threshold voltage of the driving transistor that drives the current deteriorates, by effectively storing the threshold voltage of the amorphous silicon thin film transistor. Also, the pixel structure according to the first embodiment of the present invention can reduce at maximum the deterioration of the threshold voltage itself by periodically applying a negative voltage to the gate node of the current driving TFT. Furthermore, the pixel structure according to the fourth embodiment of the present invention can minimize the number of TFTs in comparison to the conventional pixel structure, by replacing the conventional VDD line that is essential for the pixel by a signal line required in a compensation circuit, and thus a display device having an excellent reliability can be implemented.

While the present invention has been shown and described with reference to certain preferred embodiments thereof, it will be understood by those skilled in the art that various changes in form and details may be made therein without departing from the spirit and scope of the present invention as defined by the appended claims.

What is claimed is:

1. A pixel structure using a voltage programming type active matrix organic light emitting diode (OLED), the pixel structure comprising:

a first transistor receiving an external scan signal through its gate and receiving a data voltage through its source-drain current path;

an OLED receiving a first power supply voltage;

a fifth transistor receiving an external management signal (EMS) through its gate, having a source-drain current path connected to the OLED;

a second transistor having a source-drain current path connected to the source-drain current path of the first transistor at a node B, and receiving the EMS through its gate;

a third transistor having a source-drain current path connected to the source-drain current path of the fifth transistor, a gate connected to a node A, and a source connected to the node B;

a fourth transistor receiving the external scan signal through its gate, and having a source-drain current path connected to the gate and the drain of the third transistor through the node A;

a capacitor connected in series to the node A and a second power supply; and a sixth transistor having a source and a drain connected to an external clock signal and the gate of the third transistor, respectively, and having a gate directly connected to its drain, wherein the gate and drain of the third driving transistor are in a diode connection state when the EMS is low and the external scan signal through the gate of the fourth transistor is high, and wherein before applying said high external scan signal and said low EMS to the fourth transistor and the fifth transistor respectively, a negative external clock signal is applied to the gate of the third transistor through the sixth transistor so as to minimize deterioration of a threshold voltage of the third transistor by forming a negative voltage difference from source to gate in the third transistor.

2. The pixel structure as claimed in claim 1, wherein each of the transistors is composed of a n-type or p-type thin film transistor (TFT), and the TFT is one of an amorphous silicon TFT, a nanocrystalline silicon TFT, a polycrystalline silicon TFT, an organic TFT, and an oxide (transparent) TFT.

3. The pixel structure as claimed in claim 1, wherein the pixel corresponds to an OLED having a common anode structure or an OLED having a common cathode structure.

4. The pixel structure as claimed in claim 1, wherein the external scan signal is low and said EMS is high when the negative external clock signal is applied to the gate of the third transistor.

5. The pixel structure as claimed in claim 1, wherein the gate of the third transistor is precharged by the first power supply voltage when the scan signal is high and the EMS is high.

* * * * *